US005158015A

United States Patent [19]

Harada et al.

[11] Patent Number: 5,158,015

[45] Date of Patent: Oct. 27, 1992

[54] COMPACT PRINT WHEEL PRINTER WITH LIFE EXTENDED CHARACTER SELECTION CAPABILITY

[75] Inventors: Yasuhiro Harada; Toshio Nakata, both of Suwa, Japan

[73] Assignee: Seiko Epson Corporation, Japan

[21] Appl. No.: 534,691

[22] Filed: Jun. 7, 1990

[30] Foreign Application Priority Data

Jun. 8, 1989 [JP] Japan ..... 1-146482
Oct. 4, 1989 [JP] Japan ..... 1-259395
Feb. 9, 1990 [JP] Japan ..... 2-30330

[51] Int. Cl.[5] ..... B41J 1/22

[52] U.S. Cl. ..... 101/93.18; 101/93.21; 101/93.22

[58] Field of Search ..... 400/17-21, 400/24, 25, 28, 85, 86, 95; 101/93.17, 93.18, 93.19, 93.20, 93.21, 93.22

[56] References Cited

U.S. PATENT DOCUMENTS

| | | | |
|---|---|---|---|
| 536,448 | 3/1895 | Teal | 101/86 |
| 1,266,807 | 5/1918 | Hubbard | 101/85 |
| 1,951,682 | 3/1934 | Varren | 101/93 |
| 3,269,306 | 2/1964 | Smilgys | 101/85 |
| 4,314,505 | 2/1982 | Krembel, Jr. | 101/18 |
| 4,328,747 | 5/1982 | Fujiwara et al. | 101/93.17 |
| 4,416,557 | 11/1983 | Arai | 400/152 |
| 4,760,785 | 8/1988 | Hori | 101/93.18 |
| 4,804,282 | 2/1989 | Hori | 101/93.21 |

FOREIGN PATENT DOCUMENTS

| | | | |
|---|---|---|---|
| 0028808 | 2/1980 | Japan | 101/85 |
| 0028810 | 2/1980 | Japan | 101/85 |
| 0034459 | 4/1981 | Japan | 101/93.18 |
| 0089186 | 5/1984 | Japan | 101/93.18 |
| 0152772 | 7/1987 | Japan | 101/93.21 |
| 2108431 | 5/1983 | United Kingdom . | |

*Primary Examiner*—Edgar S. Burr
*Assistant Examiner*—John S. Hilten
*Attorney, Agent, or Firm*—W. Douglas Carothers, Jr.

[57] ABSTRACT

A print wheel printer of the type having a print wheel spring extension releasably engaged in a primary indent formed in the circumferential surface of the print wheel shaft is provided with relative angular surface relationships for the spring indent or spring extension such that the initial impact and force of the spring extension dropping or falling into the shaft indent is reduced extending the life of the printer while concurrently reducing the noise level of the printer operation. An auxiliary indent is also formed in the circumferential surface of the print wheel shaft in advance of the primary indent to provide for minimal engagement of the print wheel extension with the print wheel shaft during periods of time when the print wheel spring extension is not in engagement relative to the primary indent.

8 Claims, 8 Drawing Sheets

FIG._2
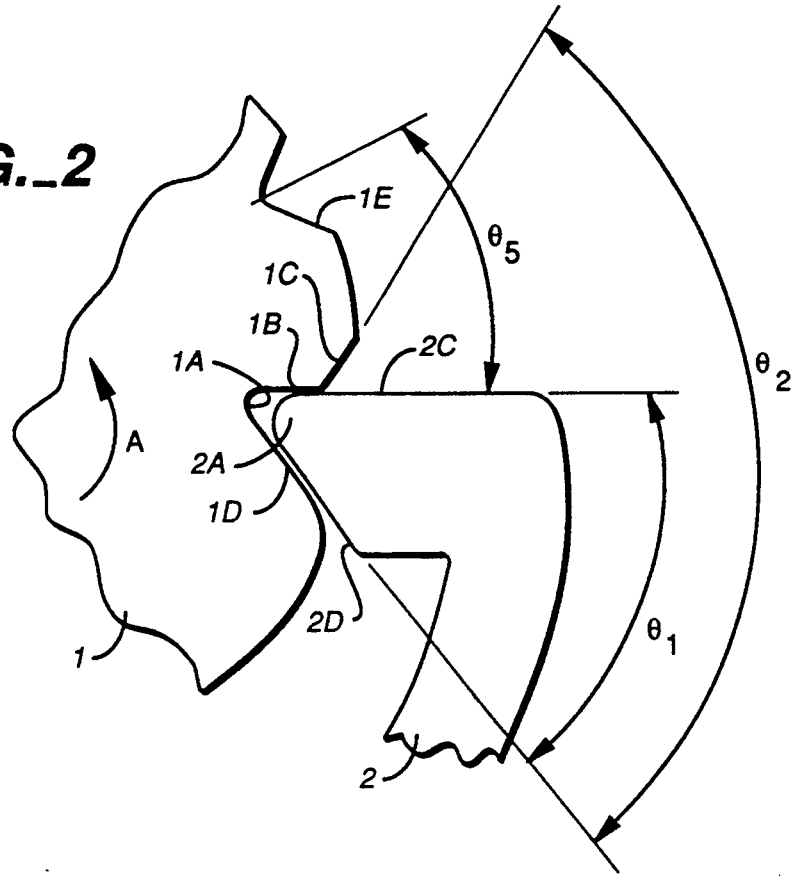
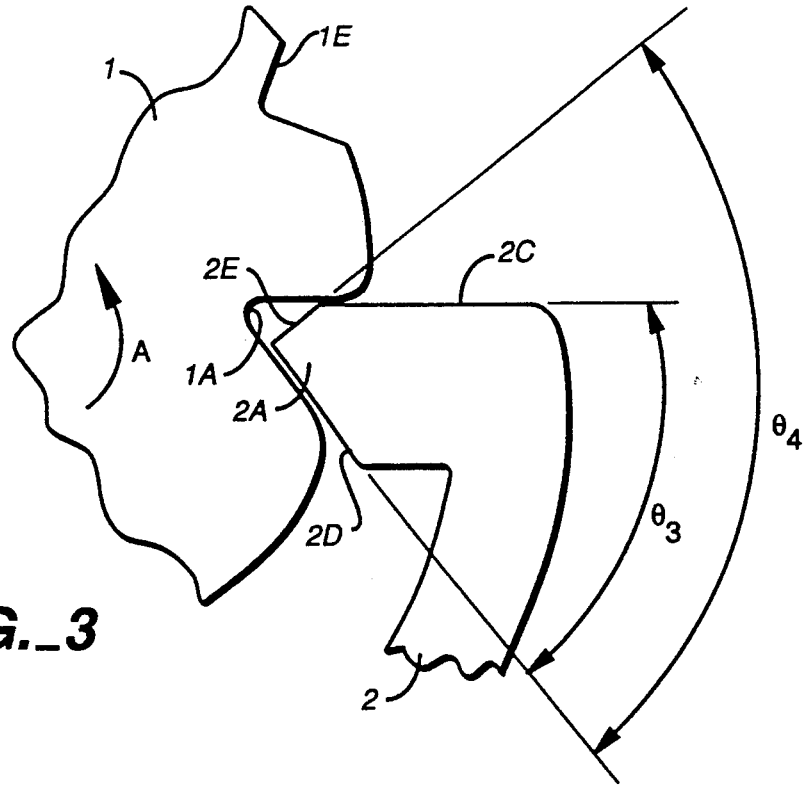
FIG._3

COMPACT PRINT WHEEL PRINTER WITH LIFE EXTENDED CHARACTER SELECTION CAPABILITY

BACKGROUND OF THE INVENTION

This invention relates generally to compact print wheel printers and more particularly to a compact print wheel printer having low operational noise and low power consumption with a superior, life extended character selection capability.

In small, compact print wheel printers, such as the type employed in calculators, cash registers and the like, there is formed a single indent in the outer surface of the print wheel shaft of the printer. The angle of the forward surface or forward edge of this single print wheel shaft indent relative to the direction of rotation, A, of the print wheel shaft is provided to permit an extension of a print wheel spring held about the print wheel shaft to slip into and engage the shaft indent so that the configuration of indent is fixed regardless of the depth of the indent and the angle of the print wheel spring extension which slips into and engages the indent is also fixed.

Further, the print wheel shaft indent is provided only for positioning and maintaining a releasably fixed relationship of movement or unitary motion between the print wheel shaft and the print wheel until the print wheel is stopped at a selected position by means of a character selection pawl wherein the desired character or font on the periphery of the print wheel is printed. When the print wheel is stopped by the pawl, the spring extension is released from the shaft indent so that the print wheel no longer rotates in unison with the print wheel shaft.

FIGS. 4A and 4B disclose the prior art arrangement of a print wheel 3, print wheel shaft 1 and print wheel spring 2 of a compact print wheel printer of the foregoing described type. Print wheel shaft 1 has an indent 1' on its surface wherein the extension 2' of spring 2 may engage and bring about a fixed engagement between shaft 1 and print wheel 3 since spring 2 is fixed at its other end to print wheel 3.

As shown in FIG. 4C, surface 1'' of indent 1', onto which print wheel spring 2 slips and engages, is parallel to the direction, E, of the motion of print wheel spring 2 as held about print wheel shaft 1 and the angle of print wheel spring extension 2' is also parallel to this same surface 1''. The direction of motion, E, of spring extension 2' is substantially radial relative to the center of shaft 1. As a result, when the print wheel spring extension 2' slips into shaft indent 1', a a high force impact is created which is accompanied with a high noise level due to the spring extension 2' falling the full depth of shaft indent 1' in one continuous and uninterrupted movement, which causes, over time, excessive wear on print wheel spring 2. This has been remedied, in part, by manufacturing spring 1' with higher strength material. However, this, in turn, causes excessive wear on shaft indent 1' and results in an even greater noise level of operation.

As shown in FIG. 4B, and more particularly in enlarged detail view of FIG. 4C, surface 1'', upon which print wheel spring 2 first engages and falls onto shaft indent 1', becomes excessively worn, as shown at 2'' and, therefore, is no longer parallel to the above mentioned direction, E. As a result, spring extension 2' is no longer properly and accurately positioned in shaft indent 1'. Further, there results a degradation in the character selection function since the engagement of the end of spring extension 2' along this surface 1'' is no longer smooth and is interrupted by the formed irregular worn surface 2''. Thus, accurate positioning and degradation of the character selection function occurs because for accurate positioning, it is necessary for print wheel spring extension 2' to slide along a smooth surface 1'' to reach the full depth of shaft indent 1' since ultimate fine print wheel positioning for proper character printing is performed, in part, by the cooperative relationship of the bottom radius of indent 1' and the end radius of print wheel spring extension 2'.

Furthermore, only one such indent 1' is provided in print wheel shaft 1' for maintaining the unitary motion of print wheel shaft 1 and print wheel 3 during the character selection process. As a result, print wheel spring 2 has to be constructed of high strength and durable material to permit the print wheel printer to accommodate high speed printing. This results in increased noise when the print wheel spring 2 slips into and engages in print wheel shaft indent 1' and, further, requires a greater drive force to be placed upon print wheel shaft 1, which, in turn, increases the resultant power consumption necessary for high speed printing operation of the printer.

It is a principal object of this invention to solve the foregoing mentioned disadvantages of print wheel printers of the prior art.

It is another object of this invention to provide means by which the foregoing mentioned excessive wear can be significantly reduced while also significantly reducing the level of noise produced by the print wheel printer.

It is still another object of this invention to provide a compact print wheel printer having low operational noise and low power consumption with a sustained or life extended, superior and accurate character selection capability.

SUMMARY OF THE INVENTION

According to this invention, a print wheel printer of the type having a print wheel spring extension releasably engage in an indent formed in the circumferential surface of the print wheel shaft is provided with relative angular surface relationships for the spring indent or spring extension such that the initial impact and force of the spring extension dropping or falling into the shaft indent is reduced which, in turn, reduces the noise level of printer operation. Further, the power consumption required to dislodge the spring extension from the shaft indent to permit character selection is reduced.

Relative to one embodiment of this invention, when print wheel spring extension engages the indent on the print wheel shaft, the spring extension initially slips along an angular flat surface leading into the indent and formed adjacent to the outer circumference of the print wheel shaft. Thereafter, the spring extension slides, rather than falls or drops, into the bottom of the shaft indent due to a reduction in the rate or speed of movement of the spring extension and the spring extension becomes fully engaged within the shaft indent. Once the spring extension is in its fully engaged position in the shaft indent, a releasably locked relation is established between the print wheel shaft and the print wheel so that these two components move in locked relation during the printer character selection process for positioning and subsequent printing of a selected character or font on the periphery of the print wheel. As a result, excessive wear on the print wheel shaft indent and the print wheel spring is significantly reduced and the useful life of these printer parts is extended and their accuracy to continually provide for accurate character selection during the character selection process is sustained.

Thus, the wear on the surfaces of the shaft indent are materially reduced due to the added sliding characteristic of the spring extension engaging the shaft indent rather than dropping or falling the full depth of the shaft indent. Further, the spring force required for the print wheel spring extension to slip into and out of engagement with the print wheel shaft indent is reduced. Also, a lower noise level is realized during the printer reset process when the spring extension becomes engaged with the shaft indent in order that the print wheel and print wheel shaft move and rotate in unison during the character selection process.

In addition, since the print wheel spring extension is positioned by the shaft indent and the outer end surface of the print wheel spring extension, accurate positioning of the character print wheel is achieved and the unitary movement of the print wheel shaft and the print wheel may be accomplished with at least two indents on the print wheel shaft, i.e., a primary indent and an auxiliary indent. As a result, a reduced print wheel spring force can be utilized for the print wheel spring and, therefore, less power consumption is necessary in rotating the print wheel shaft to bring about the operation of dislodging the spring extension from the print wheel shaft indent during the character selection process.

The following results are achieved by the practice of this invention. First, the rate of movement and impact with which the print wheel spring extension slips into and fully engages the print wheel shaft indent is reduced, i.e., the engagement process is designed to be more gradual and of reduced final depth, compared to the swift and immediate full drop of the spring extension into the shaft indent experienced with the prior art structure of FIG. 4. As a result, the positioning accuracy of the print wheel shaft and the print wheel in the character selection process is sustained and the operational life of the printer is extended because of improved durability against the wearing of the print wheel shaft and spring parts, and, concurrently, the operational noise level is significantly reduced.

Secondly, by employing more than one indent on the print wheel shaft, the ability of the print wheel to follow the print wheel shaft during the printer reset operation is improved so that high speed operation of the printer can be achieved with a smaller print wheel spring force resulting in lower noise level and lower power consumption for printer operation.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2 is a detail view of the print wheel shaft and spring mechanism relative to the first embodiment of this invention.

FIG. 3 is a detail view of the print wheel shaft and spring mechanism relative to a second embodiment of this invention.

DESCRIPTION OF THE PREFERRED EMBODIMENTS

Figure 1A:
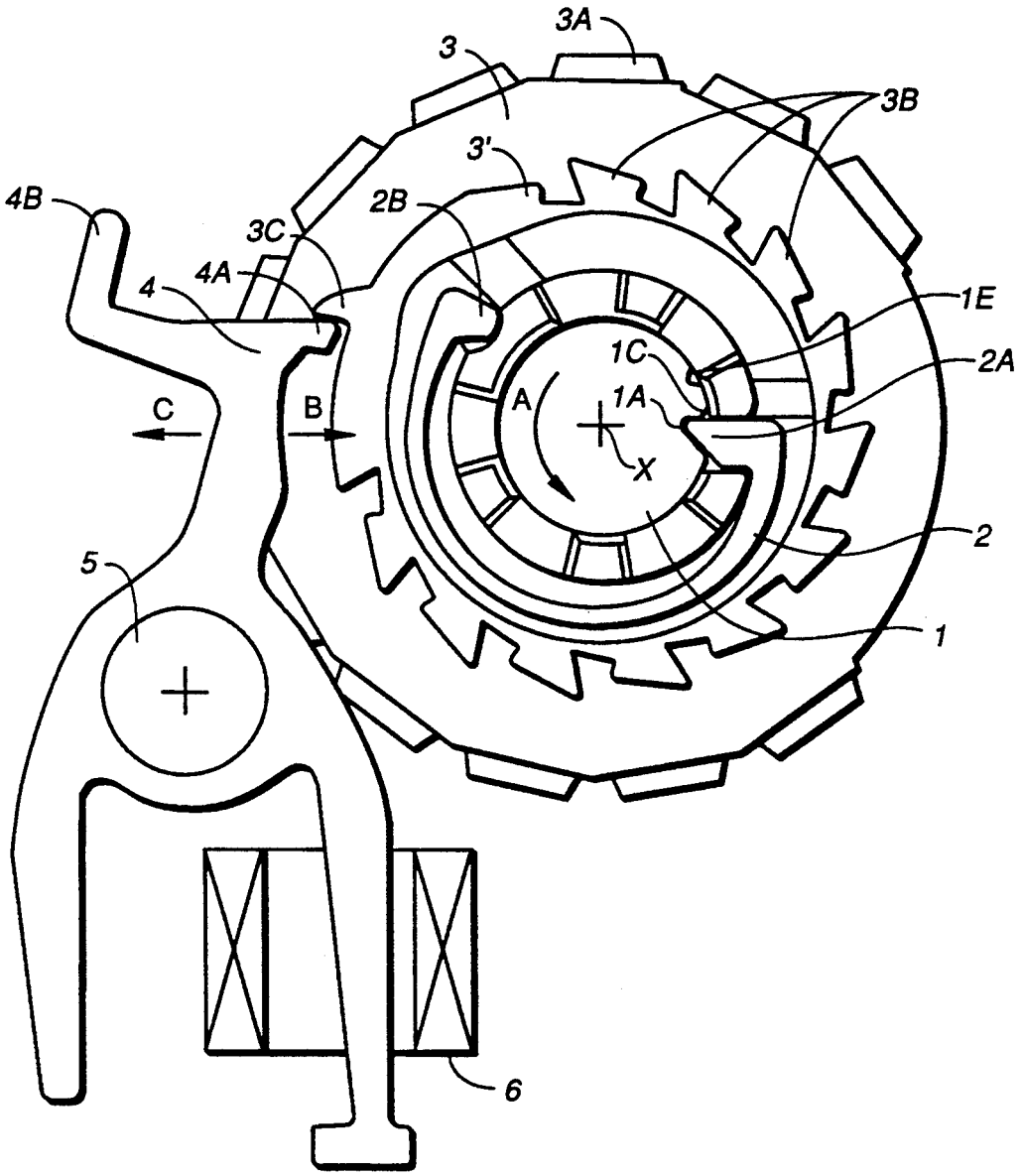
FIGS. 1A-1E are a series of cross sectional views for the purposes of describing the structure and operation of a first and second embodiments of this invention.

Reference is now made to FIGS. 1 and 2 wherein there is shown the detail of engagement of the print wheel spring extension in a indent of the print wheel shaft indent of a small, compact printer comprising this invention. The arrangement shown is of a single print wheel 3 and corresponding character selection pawl 4. However, there are a series of such print wheels 3 positioned in parallel on print wheel shaft 1 each having an associated character selection pawl 4, as is known in the art.

FIGS. 1 and 2 illustrate the engagement condition of spring extension 2A of print wheel spring 2 in indent 1A of print wheel shaft 1 wherein spring 2 maintains the unitary or fixed relation of print wheel shaft 1 and print wheel 3 during the character or font selection process, as is known in the art. The angular side surfaces of shaft indent 1A are engaged by spring extension 2A comprising two angular surfaces 1B and 1D, as best shown in FIG. 2. Angular leading surface 1B, which is substantially radial relative to center, X, of shaft 1, forms angle $\theta_1$ with opposing angular trailing surface 1D. Angular flat topical surface 1C, which is approximate to the outer circumference of shaft 1, forms angle $\theta_2$ with angular trailing surface 1D. In this connection, $\theta_2$ is greater than $\theta_1$.

In addition to indent 1A, print wheel shaft 1 further includes an auxiliary indent 1E and is positioned at a radial angle $\theta_5$ in front or ahead of indent 1A relative to the direction of rotation, A, of print wheel shaft 1.

Reference is now made to FIGS. 1A-1E relative to the operation of print wheel 3 in conjunction with print wheel shaft 1 and print wheel spring 2 during the character or font selection process and the print wheel reset process with particular attention directed to the releasably locked relationship of print wheel shaft 1 and print wheel spring 2. It should be noted that print wheel spring 2 is assembled with print wheel 3 and is held to print wheel 3 at spring extension 2B.

The standby condition for print wheel 3 and shaft 1 is illustrated in FIG. 1A wherein spring extension 2A is engaged in shaft indent 1A and, as a result, both the relationship and rotational movement of print wheel shaft 1 and print wheel 3 are in a locked state. Also, in the standby position, print wheel shaft 1 is not in rotational motion.

Print wheel 3 includes on its periphery or circumference a plurality of characters or fonts 3A and on one side thereof has a fixed ratchet member 3' with a portion of its circumferential surface including a plurality of ratchets 3B, each corresponding with a particular character 3A. Another portion of the circumferential surface of ratchet member 3' includes reset claw 3C.

Character selection claw 4 is rotatably supported by and rotates on selection claw shaft 5. When the character selection process is initiated, trigger coil 6 is energized and selection claw 4 rotates in the direction of arrow B and engages a selected ratchet 3B. When the reset process is initiated, selection claw 4 rotates in the direction of arrow C and does not engage any of the ratchets 3B or reset claw 3C.

Figure 1B:
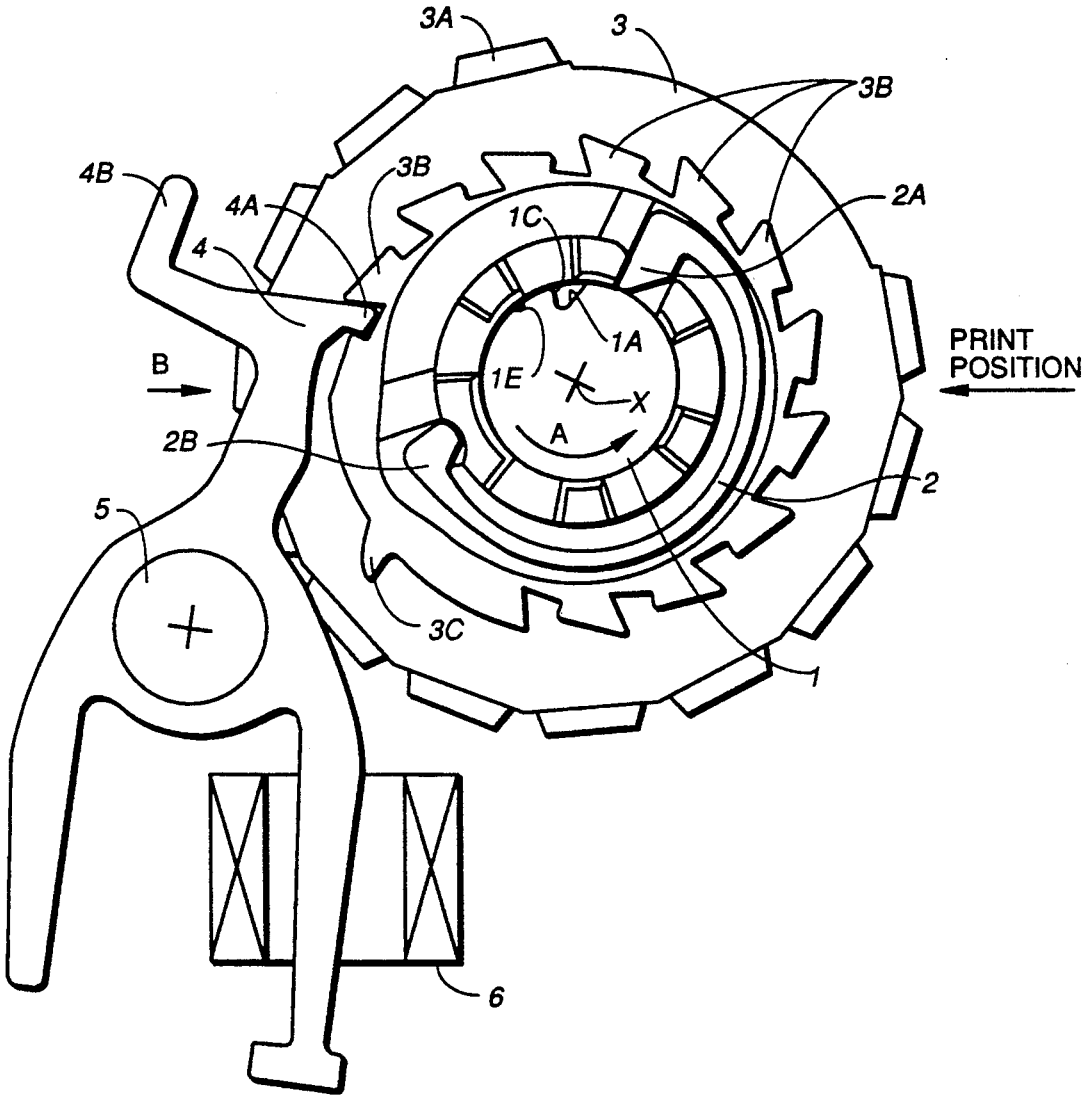

At the beginning of the character selection process in response to a print command to the printer, selection claw 4 is rotated in the direction of arrow C by a reset lever (not shown) which engages pawl extension 4B. As a result, the engagement of pawl end 4A of selection claw 4 with reset claw 3C of print wheel 3, as shown in FIG. 1A, is released. Concurrently with the setting of pawl 4 in this release position, shaft 1 begins rotational movement. Since print wheel 3 is in locked engagement with print wheel shaft 1 due to spring extension 2A in shaft indent 1A, print wheel 3 begins rotation in the direction of arrow A by means of a drive motor (not shown) coupled to print wheel shaft 1. At this time, end 4A of selection claw 4 is outside the rotational path of reset claw 3C so that the tip of reset claw 3C rotates past pawl end 4A. Selection claw 4 then rotates back to the standby position of FIG. 1A and the character selection process is completed within the next single revolution of print wheel shaft 1. Print wheel 3 continues to rotate while maintaining locked relationship with the print wheel shaft 1 and when a selected character 3A on print wheel 3 rotates and reaches the printing position, trigger coil 6 is energized causing selection claw 4 to rotate in the direction of arrow B and, as indicated in FIG. 1B, pawl end 4A engages a selected print wheel ratchet 3B corresponding to character 3A to be printed. At this time, the rotational movement of print wheel 3 is terminated because print wheel 3 is held by pawl 4 from further rotation. However, print wheel shaft 1 continues its rotational movement via the printer motor and, as a result, spring extension 2A of print wheel spring 2 is forced out of shaft indent 1A, as shown in FIG. 1B. Thus, print wheel shaft 1 and print wheel 3 are disengaged at this time from their previous locked engagement.

Print wheel shaft 1 continues to rotate until all selected characters 3A on the several print wheels 3 of the print wheel printer have been selected via corresponding selection claws 4 so that all selected print wheel characters all arranged in parallel are at their selected printing position as illustrated in FIG. 1B at "PRINTING POSITION". At this time, the printing process is initiated.

Figure 1C:
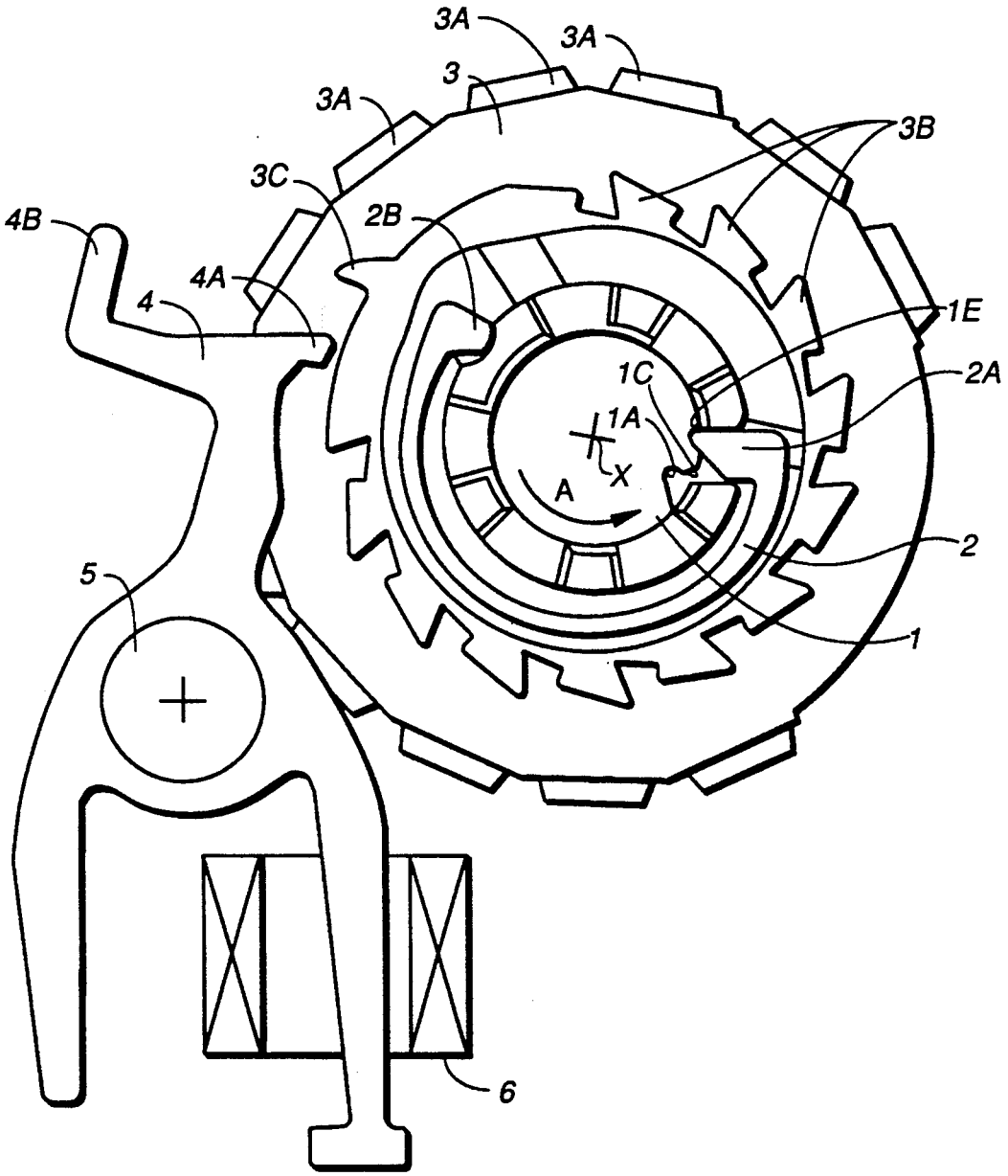

Upon completion of the printing process, the reset process is initiated which occurs within the next single revolution of print wheel shaft 1. In the reset process, the engagement of selection claw 4 with a previously selected ratchet 3B of the several print wheels 3 is released and print wheel shaft 1 rotation is again initiated. At this particular time, print wheel 3 will tend to follow with the rotational movement of print wheel shaft 1 in the direction of arrow A due to the frictional force produced by the spring force of print wheel spring 2 on the surface of shaft 1. However, in the case where high speed printing is to be achieved, the reset process cycle is very fast and, as a result, print wheel 3 will not obediently follow the rotational operation of print wheel shaft 1 due to the frictional force produced by the spring force of print wheel spring 2 and the inertial weight of print wheel 3. As a result, its phase relation relative to the cyclic reset operation becomes gradually delayed. As illustrated in FIG. 1C, as the phase relation between print wheel 3 becomes further and further delayed with respect to print wheel shaft 1, spring extension 2A becomes finally engaged in shallow auxiliary indent 1E on print wheel shaft 1, which is in front of primary indent 1A relative to the rotational direction A.

Figure 1D:
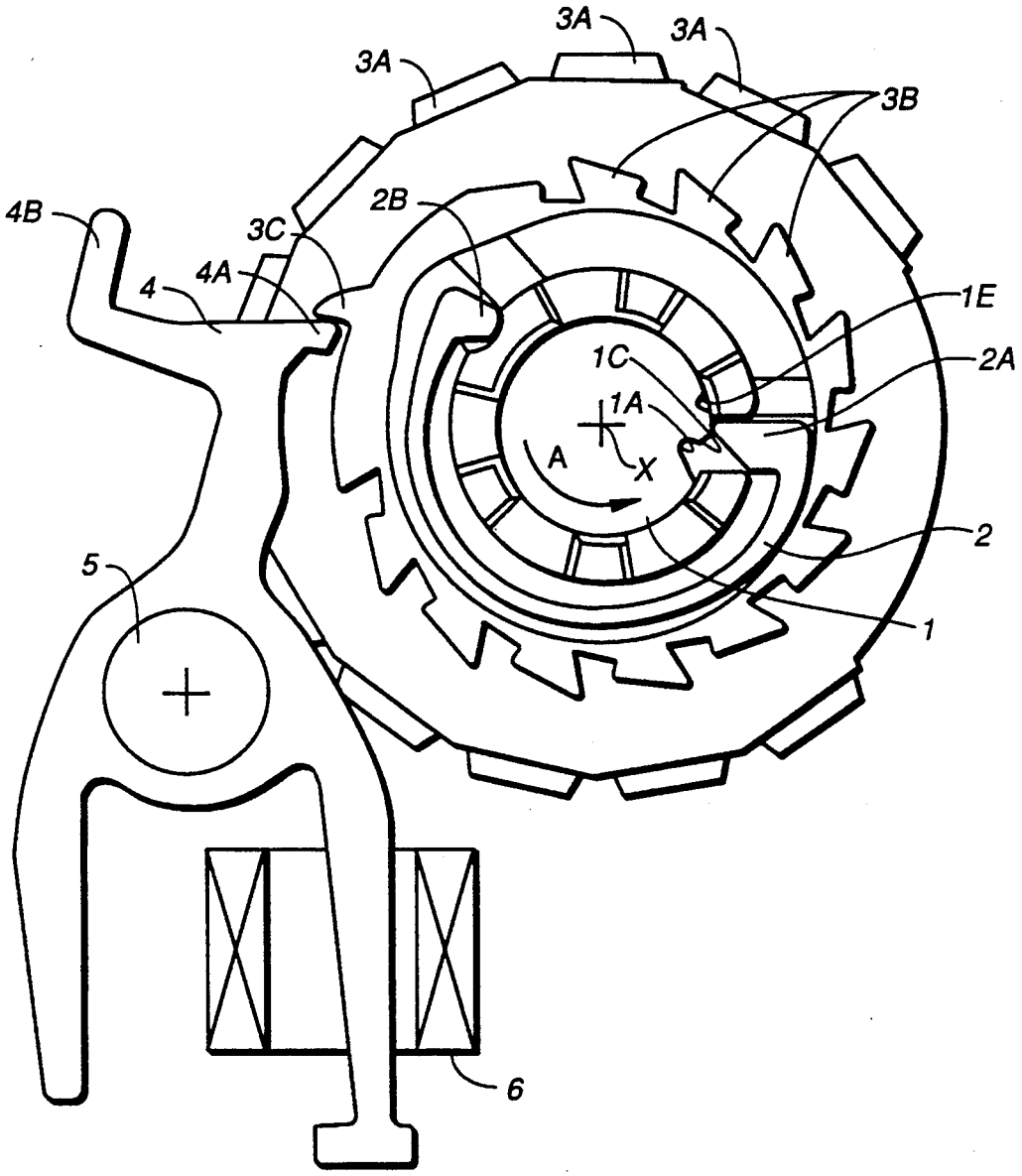

It should be noted that the shape or contour of auxiliary indent 1E is smaller than the contour of indent 1A so that the force of spring 2 is sufficient to maintain spring extension 2A in shallower auxiliary indent 1E in order to maintain a fixed unitary relationship between print wheel 3 and shaft 1 so that again print wheel 3 rotates in unison with print wheel shaft 1. This regained locked rotational movement between print wheel shaft 1 and print wheel 3 remains until reset claw 3C of print wheel 3 engages selection claw end 4A, as shown in FIG. 1D, and terminates rotational motion of print wheel 3. However, since print wheel shaft 1 continues to rotate, spring extension 2A is forced out of auxiliary indent 1E, as indicated in FIG. 1D, and slips into and engages indent 1A thereby once again returning the cyclic operation of the printer to the standby condition first illustrated in FIG. 1A.

Figure 1E:
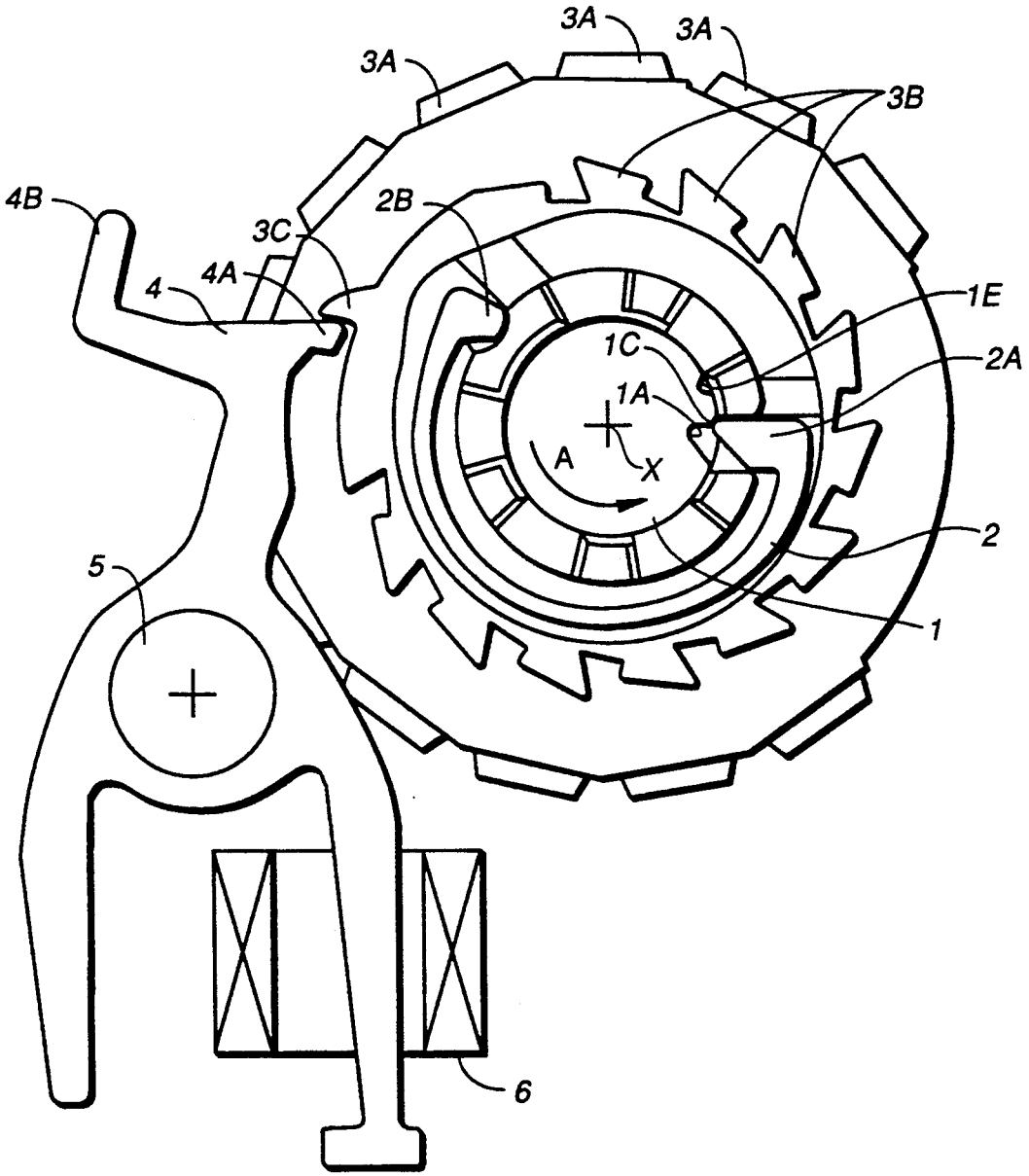

At this particular time wherein spring extension 2A again engages shaft indent 1A, spring extension 2A does not immediately engage the full depth of indent 1A in a single step of movement, but rather, as illustrated in FIGS. 1E, spring extension 2A gradually slides down along angular flat surface 1C of indent 1A, adjacent to the outer circumference of print wheel shaft 1, and then spring extension 2A moves into indent 1A to the bottom thereof whereby its overall rate of movement into indent 1A is significantly reduced and its impact therein is materially lessened. In this manner, surface 1C lessens the impact of spring extension 2A into shaft indent 1A since it permits the latter to both gradually slide into indent 1A as well as, in reality, reduce the effective indent depth to complete the engagement of spring extension 2A in shaft indent 1A.

As an example relative to the embodiment of FIG. 2, angular surfaces 1C and 1B may be respectively set at angles $\theta_1=55°$ and $\theta_2=120°$ from angular trailing surface 1D. $\theta_5$ may be about 20°. However, other angular relationships for $\theta_1$, $\theta_2$ and $\theta_5$ can be set as long as $\theta_2>\theta_1$. Because of flat surface 1C, surfaces 1B and 1D receive about one half of the amount of the full engaging force of print wheel spring 2. Consequently, the noise level of operation is reduced by approximately 3 dB and the long term positioning accuracy of print wheel 3 relative to print wheel shaft 1, necessary for accurate print wheel positioning, is improved and maintained. As indicated, this result is achieved when the angles $\theta_1$ and $\theta_2$ satisfy the condition that $\theta_1>\theta_2$.

Figure 4A:
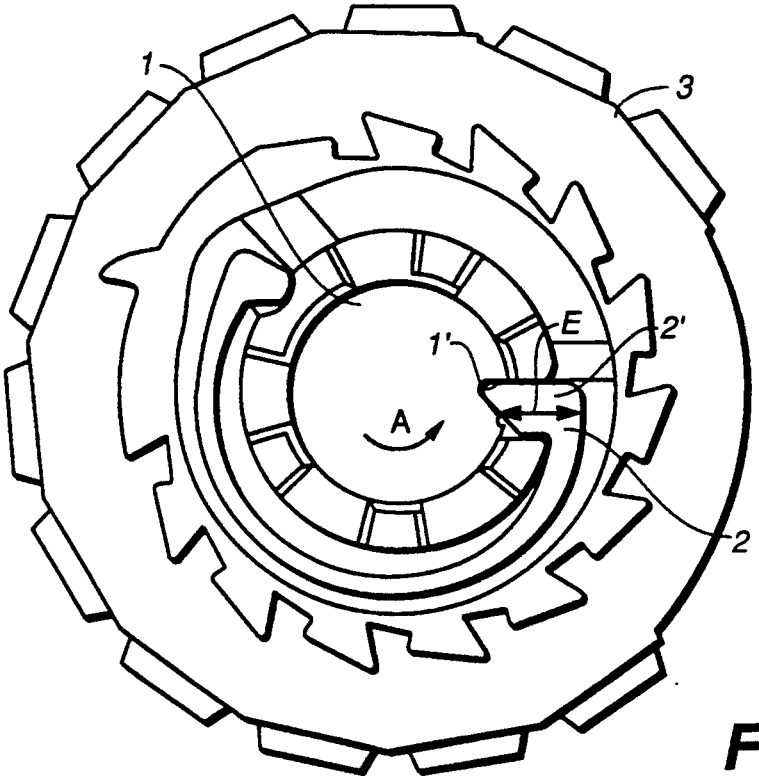
FIG. 4A (PRIOR ART)
FIGS. 4A, 4B and 4C are cross sectional views of a print wheel shaft and spring mechanism as known in the art.
Figure 4B:
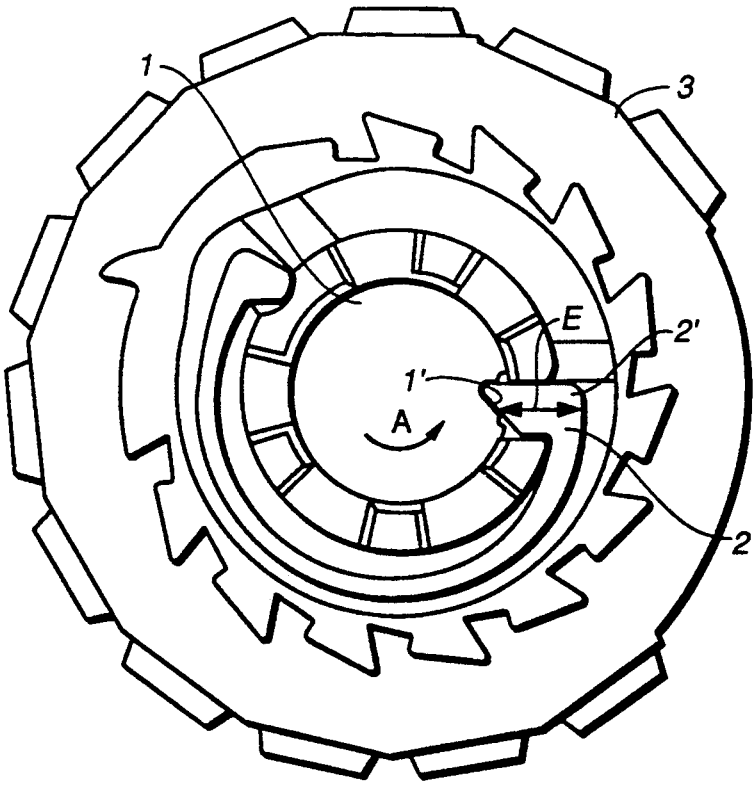
FIG. 4B (PRIOR ART)
Figure 4C:
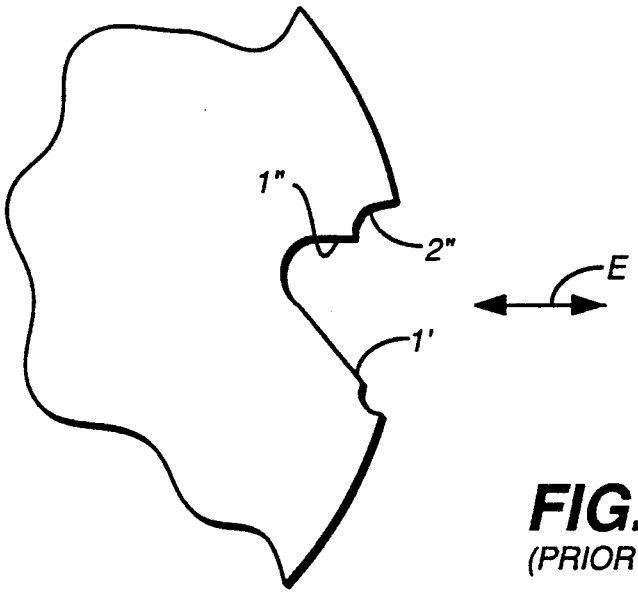
FIG. 4C (PRIOR ART)

Further, since the depth of auxiliary indent 1E is approximately one third that of primary indent 1A and the angle $\theta_5$ formed between the radial positions of indents 1E and 1A is, for example, approximately 20° to 30°, the printer is able to withstand printing speeds approximately twice those utilizing the prior art design illustrated in FIG. 4. Also, the shape or contour of indent 1E, its angular relationship, $\theta_5$, about the circumference of shaft 1 and the number of auxiliary indents 1E utilized on the surface of shaft 1 can be set as desired, although only one such auxillary indent is generally necessary.

FIG. 3 is a detail drawing illustrating another embodiment of this invention wherein spring extension 2A is modified with flat surface 2E rather than shaft indent 1A and, therefore, the embodiment of FIG. 3 is the antithesis of the embodiment of FIG. 2.

Angular surface 2D forms an angle $\theta_4$ with end flat surface 2E of spring extension 2A and forms an angle angle $\theta_3$ with trailing surface 2C of spring extension 2A, where the relationship of $\theta_4 > \theta_3$ is maintained. Angular surface 1D of shaft indent 1A receives angular surface 2D of spring extension 2A and thereafter slides into shaft indent 1A.

The operation of the embodiment of FIG. 3 is the same as that for the embodiment shown in FIG. 2 so that the explanation relative to FIGS. 1A-1E is equally applicable to the structure for operation of print wheel spring 2 of FIG. 3.

It should be noted that in the practice of this invention relative to the utility of surface 1C of FIG. 2 and surface 2E of FIG. 3, auxiliary indent 1E is not essential.

While the invention has been described in conjunction with several specific embodiments, it is evident to those skilled in the art that many further alternatives, modifications and variations will be apparent in light of the foregoing description. For example, the embodiments of FIGS. 2 and 3 relative to the combination of flat surfaces 1C and 2E can be combined to form a third embodiment of this invention. Further, surfaces 1C and 2E need not be perfectly flat but could also be slightly curved, concave or convex, for example. Thus, the invention described herein is intended to embrace at such alternatives, modifications, applications and variations as fall within the spirit and scope of the appended claims.

What is claimed is:

1. A print wheel selection type compact printer comprising:

at least one print wheel having a plurality of characters on its outer circumference.

a print wheel spring assembled with said print wheel and having an extension.

a print wheel shaft for rotatably supporting said print wheel.

a primary indent formed in an outer surface of said print wheel shaft for locking engagement with said print wheel spring extension to bring about unified rotational movement of said print wheel with said print wheel shaft during operation of said printer.

means to engage and disengage said print wheel spring extension from said print wheel shaft primary indent.

means formed on said print wheel shaft primary indent to reduce the force of impact and rate of motion of said print wheel spring extension falling into said print wheel shaft primary indent thereby reducing the amount of wear due to said engagement and disengagement of said print wheel spring extension with said print wheel shaft primary indent as well as the operational noise of said printer.

an auxiliary indent formed on said print wheel shaft in advance of said primary indent having means to permit minimal gripping engagement by said print wheel shaft spring extension therein when said print wheel spring extension is disengaged from said print wheel shaft primary indent and to provide for said unified rotational movement until reinitiation of engagement of said print wheel spring extension with said print wheel shaft primary indent.

2. The print wheel selection type compact printer of claim 1 wherein said means to reduce comprises a leading surface of said print wheel shaft primary indent in the direction of rotation of said print wheel shaft having a profile consisting of at least one angular engagement surface for accommodating movement of said print wheel spring extension into said print wheel shaft primary indent reducing the impact and rate of motion of said print wheel spring extension as said spring extension is fully engaged in said print wheel shaft primary indent.

3. The print wheel selection type compact printer of claim 1 wherein said auxiliary indent is shallower in depth than said primary indent so that said print wheel spring extension when engaged in said auxiliary indent can be easily unlocked from said print wheel shaft.

4. The print wheel selection type compact printer of claim 1 wherein said means to reduce is formed on both said print wheel shaft indent and on said print wheel spring extension to reduce the force of impact and rate of motion of said print wheel spring extension falling into said print wheel shaft primary indent.

5. A print wheel selection type compact printer comprising:

at least one print wheel having a plurality of characters on its outer circumference, a print wheel spring assembled with said print wheel and having an extension, a print wheel shaft for rotatably supporting said print wheel, a primary indent formed in an outer surface of said print wheel shaft for locking engagement with said print wheel spring extension to bring about unified rotational movement of said print wheel with said print wheel shaft during operation of said printer, means to engage and disengage said print wheel spring extension from said print wheel shaft primary indent, means formed on said print wheel spring extension to reduce the force of impact and rate of motion of said print wheel spring extension falling into said print wheel shaft primary indent thereby reducing the amount of wear due to said engagement and disengagement of said print wheel spring extension with said print wheel shaft primary indent as well as the operational noise of said printer, an auxiliary indent formed on said print wheel shaft immediately in advance of said primary indent having means to permit minimal gripping engagement by said print wheel shaft spring extension therein when said print wheel spring extension is disengaged from said print wheel shaft primary indent and to provide for said unified rotational movement until reinitiation of engagement of said print wheel spring extension with said print wheel shaft primary indent.

6. The print wheel selection type compact printer of claim 5 wherein said means to reduce comprises a leading surface of said print wheel spring extension in the direction of rotation of said print wheel shaft having a profile consisting of at least one angular engagement surface for accommodating movement of said print wheel spring extension into said print wheel shaft primary indent reducing the impact and rate of motion of said print wheel spring extension as said spring extension is fully engaged in said print wheel shaft primary indent.

7. A print wheel selection type compact printer comprising:

at least one print wheel having a plurality of characters on its outer circumference, a print wheel spring assembled with said print wheel and having an extension, a print wheel shaft for rotatably supporting said print wheel, a primary engagement means formed in an outer surface of said print wheel shaft providing for locking engagement with said print wheel spring extension to bring about unified rotational movement of said print wheel with said print wheel shaft during operation of said printer, means to engage and disengage said print wheel spring extension from said print wheel shaft primary indent, an auxiliary engagement means formed on said print wheel shaft in advance of said primary engagement means wherein the angular relationship between both of said engagement means forms an acute angle relative to the rotational center of said print wheel shaft, said auxiliary engagement means being of a smaller size compared to said primary engagement means so that disengagement of said print wheel shaft spring extension from said auxiliary engagement means by said engagement/disengagement means is accomplished with less applied force compared to disengagement of said print wheel shaft spring extension from said primary engagement means by said engagement/disengagement means, said auxiliary engagement means providing for minimal gripping engagement by said print wheel shaft spring extension therein when said print wheel spring extension is disengaged from said print wheel shaft primary engagement means to provided for said unified rotational movement until reinitiation of engagement of said print wheel spring extension with said print wheel shaft primary engagement means.

8. The print wheel selection type compact printer of claim 7 wherein said primary and auxiliary engagement means respectively comprise an indent in said print wheel shaft, said auxiliary indent having a depth in said print wheel shaft that is shallower than the depth of said primary indent so that said print wheel spring extension can easily be disengaged from auxiliary indent in said print wheel shaft.

* * * * *